United States Patent [19]

Sakamoto et al.

[11] 4,321,016

[45] Mar. 23, 1982

[54] APPARATUS FOR CONTINUOUS SLURRY DISPLACEMENT TRANSFER

[75] Inventors: Masakatsu Sakamoto, Matsudo; Kenji Uchida, Kashiwa, both of Japan

[73] Assignee: Hitachi, Ltd., Tokyo, Japan

[21] Appl. No.: 136,721

[22] Filed: Apr. 2, 1980

[30] Foreign Application Priority Data

Apr. 4, 1979 [JP] Japan ..... 54-39823

[51] Int. Cl.[3] ..... F04B 21/00; F04F 11/00

[52] U.S. Cl. ..... 417/63; 417/102; 417/103; 417/900

[58] Field of Search ..... 92/5 R; 417/9, 63, 102, 417/103, 900; 141/1, 67, 392

[56] References Cited

U.S. PATENT DOCUMENTS 2,915,975 12/1959 Kittrell et al. ..... 417/9

3,556,682 1/1971 Sakamoto et al. ..... 417/102

*Primary Examiner*—Frederick R. Schmidt

*Attorney, Agent, or Firm*—Craig and Antonelli

[57] ABSTRACT

Slurry consisting of water and solid matters are charged into a plurality of vessels by means of a low-pressure slurry pump, and is discharged into a transfer pipe by fluid pressure generated by a high-pressure driving liquid pump. A float member is positioned at the border of the slurry and the driving liquid in each vessel. Any failure taking place in the apparatus is displaced or informed on the basis of the period of time taken by each float member moving between the upper and lower limit positions or the number of movements.

7 Claims, 3 Drawing Figures

FIG. 3

| | VALVE | $A_1$ | $B_1$ | $C_1$ | $D_1$ | | $A_2$ | $B_2$ | $C_2$ | $D_2$ | | $A_3$ | $B_3$ | $C_3$ | $D_3$ |
|---|---|---|---|---|---|---|---|---|---|---|---|---|---|---|---|
| VESSEL NO.1 | FLOAT UP – FAST | | | | ▨ | | | | | | | | | | |
| | FLOAT UP – SLOW | ▨ | | | | | | | | | | | | | |
| | FLOAT DOWN – FAST | | ▨ | | | | | | | | | | | | |
| | FLOAT DOWN – SLOW | | | ▨ | | | | | | | | | | | |
| VESSEL NO.2 | FLOAT UP – FAST | | | | | | | | | ▨ | | | | | |
| | FLOAT UP – SLOW | | | | | | ▨ | | | | | | | | |
| | FLOAT DOWN – FAST | | | | | | | ▨ | | | | | | | |
| | FLOAT DOWN – SLOW | | | | | | | | ▨ | | | | | | |
| VESSEL NO.3 | FLOAT UP – FAST | | | | | | | | | | | | | | ▨ |
| | FLOAT UP – SLOW | | | | | | | | | | | ▨ | | | |
| | FLOAT DOWN – FAST | | | | | | | | | | | | ▨ | | |
| | FLOAT DOWN – SLOW | | | | | | | | | | | | | ▨ | |

APPARATUS FOR CONTINUOUS SLURRY DISPLACEMENT TRANSFER

BACKGROUND OF THE INVENTION

The present invention relates to an apparatus for continuous slurry displacement transfer and, more particularly, to an apparatus of the kind mentioned above capable of detecting any failure in the sequence beforehand and representing or informing the content of the failure.

U.S. Pat. No. 3,556,682, for example, discloses an apparatus for slurry displacement transfer comprising a plurality of vessels arranged in parallel, a low-pressure slurry pump for charging into the vessels with slurry consisting of water and solid matters and a high-pressure driving liquid pump for displacing the slurry from the vessels to an outlet pipe, wherein the position of respective float members positioned at the boundary between the slurry and the driving liquid in each vessel is detected by outside detectors which produce signals for opening and closing valves in inlet and outlet pipes for the driving liquid and valves in inlet and outlet pipes for the slurry.

In the actual operation of slurry displacement transfer apparatus, it is extremely difficult to make the discharging flow rate Q1 strictly equal to the charging flow rate Q2 of the slurry. Even if flow rate control could be perfectly performed for respective vessels, it is quite difficult in terms of accumulated errors of meters to maintain upward and downward movement of the float members within the vessels in the same manner over a long period of time.

As a measure for overcoming this problem, it has been proposed to provide a change-over means capable of effecting a switching of the operation mode between a first mode in which the charging flow rate Q2 of the slurry due to upward movement of the float members is slightly smaller than the discharging flow rate Q1 of the slurry due to downward movement of the float members (e.g. $Q2=0.95\ Q1$) and a second mode in which the former is slightly greater than the latter (e.g. $Q2=1.05\ Q1$).

In the operation of the slurry displacement transfer apparatus in the manner as described above, a detector for detecting lower limit position of the float member causes closing of a valve An in the driving liquid inlet pipe and opening of a valve An+1 in the succeeding vessel at the same time, and a detector for detecting upper limit position of the float member causes closing of a valve Cn in the driving liquid outlet pipe and opening of a valve Cn+1 in the outlet pipe for the succeeding vessel, thereby to prevent cut-off operation of the pump and reverse-flow of the slurry.

If the apparatus is operated in the condition of $Q2=1.05\ Q1$, the float member reaches its upper limit position at the level of the detector comparatively in a shorter period of time since the flow rate Q2 is larger than the flow rate Q1. In other words, the period of time during which the float member is in the lower limit position is reduced while the period of time during which it is in the upper limit position is increased. The operation mode is switched to the first mode, i.e. to the mode of $Q2=0.95\ Q1$ immediately before the sequence becomes inoperative as a result of the reduction in the period of time during which the float member is in the lower limit position. This switching is repeated during a continuous operation of the apparatus, so that the flow rates Q2, Q1 can be equal to each other over a long period of time.

In the conventional slurry displacement transfer apparatus as described above, the operator or engineer must inspect the control panel to seek for the cause of a failure when the sequence is out of order.

When the slurry is not discharged through the outlet pipe, it is presumed that, although a change-over valve A is about to be opened, a valve D in the slurry outlet pipe is in the opened state with the float having not reached yet the upper limit position. Thus, in most cases, failures are attributable to a leak in the valves. When the sequence becomes out of order as described above, it is necessary to suspend the operation of the apparatus, even when the circumstance requires to keep up with the operation for a short period of 10 to 30 minutes. It is also necessary to find out the faulty devices (valve).

SUMMARY OF THE INVENTION

It is, therefore, an object of the invention to provide a continuous slurry displacement transfer apparatus adapted to detect, display or inform details of any trouble before the sequence becomes out of order.

To this end, according to the invention, there is provided an apparatus for continuous slurry displacement transfer comprising a plurality of vessels arranged in parallel, driving liquid inlet and outlet pipes each having a valve therein and connected to the top portion of said each vessel, slurry inlet and outlet pipes each having a valve therein and connected to the bottom portion of said each vessel, float members each disposed in said each vessel, detectors provided outside of said vessels for detecting said float members coming to their upper and lower limit positions in said vessels, and a controller to which said detectors are connected; characterized by failure informing devices connected to said controller, said controller being adapted to calculate the time periods of time taken by said float members in each vessel moving between the levels of both upper and lower limit position detectors, said failure informing devices being adapted to inform the operator of any failure taking place in said apparatus when the calculated period of time has become longer or shorter than a predetermined period of time.

The above and other objects, as well as advantageous features of the invention will become more clear from the following description of the preferred embodiments taken in conjunction with the accompanying drawings.

BRIEF DESCRIPTION OF THE DRAWINGS

FIG. 3 is a table showing various troubles of valves incorporated in the apparatus of FIG. 1.

DESCRIPTION OF THE PREFERRED EMBODIMENT

Hereinafter, the invention will be more fully described with reference to attached drawings showing an embodiment of the invention.

Figure 1:
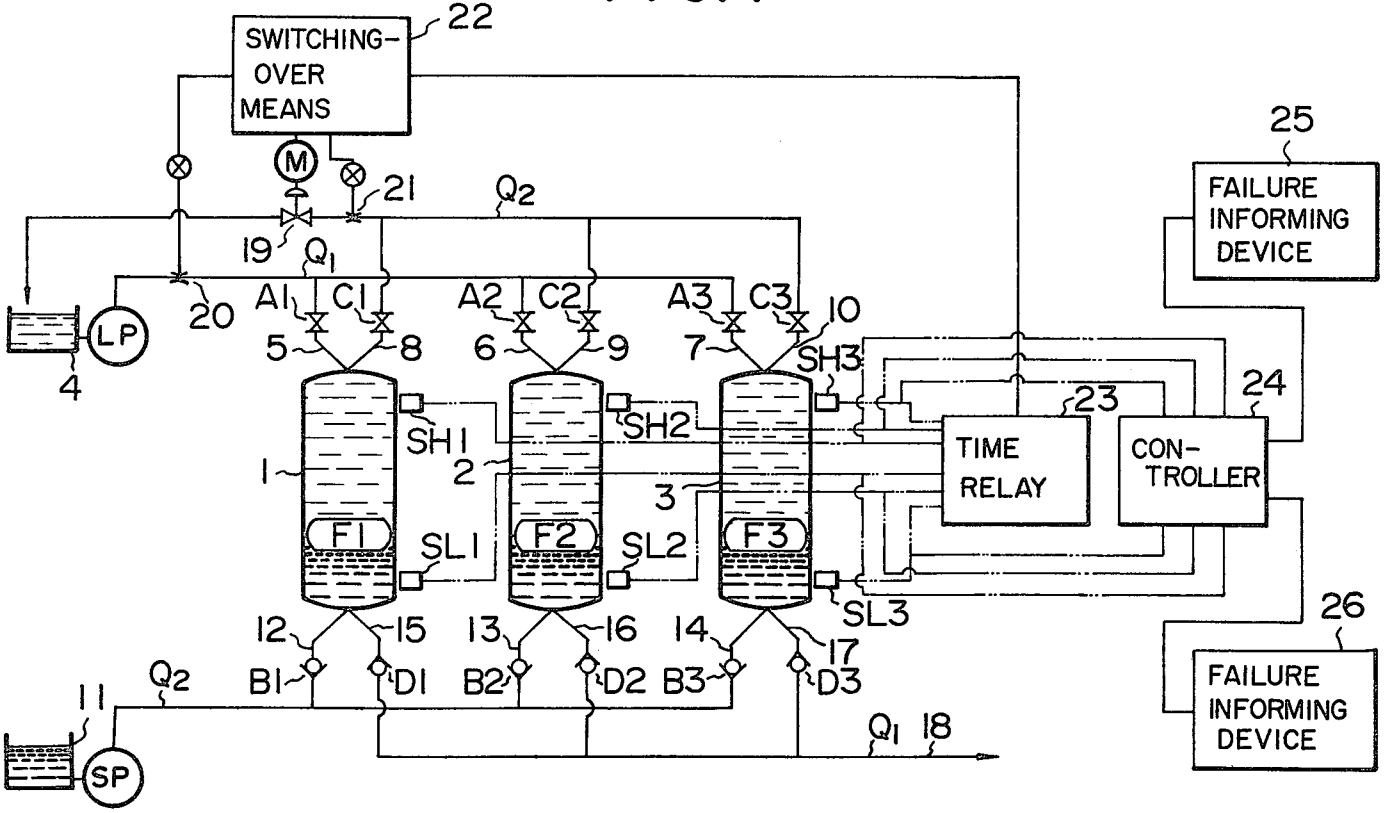
FIG. 1 is a diagrammatic view of a continuous slurry displacement transfer apparatus according to the invention.

Referring first to FIG. 1, driving liquid supply pipes 5–7 are connected to the top portions of vessels 1–3 for temporarily storing slurry. These driving liquid inlet pipes are adapted to deliver the driving liquid into the vessels 1–3 from a driving liquid tank 4 via change-over valves A1–A3 by means of a driving liquid pump LP of high delivery pressure. Also, driving liquid outlet pipes 8–10 for returning the driving liquid to the driving liquid tank 4 through change-over valves C1–C3 are connected to the top portions of the vessels 1–3. Connected to the bottom portions of the vessels 1–3 are slurry inlet pipes 12–14 adapted to charge the vessels with the slurry from a slurry tank 11 via check valves B1–B3 by means of a slurry pump SP of low delivery pressure and slurry outlet pipes 15–17 adapted for discharging the slurry through check valves D1–D3.

Float members F1–F3 are disposed within the vessels 1–3 and have a buoyancy selected such that each float member is always positioned at the boundary between the slurry and the driving liquid. Also, detectors SH1–SH3 and SL1–SL3 such as proximity switches are provided on the vessels to detect the float members when they come to the upper and lower limit positions.

The operation of this slurry displacement transfer apparatus will be described hereinunder. For simplicity of explanation, an assumption is made here that the apparatus has only one vessel.

The vessel 1 is charged with the driving liquid. The check valve D1 in the slurry outlet pipe 15 and the change-over valve A1 in the driving liquid inlet pipe 5 are in the closed position while the change-over valve C1 in the driving liquid outlet pipe 8 is opened. As the slurry pump SP is actuated in this condition, the slurry accumulated in the tank 11 is delivered into the vessel 1 forcibly through the check valve B1 in the slurry inlet pipe 12, so that the driving liquid in the vessel 1 is discharged through the change-over valve C1.

Therefore, the boundary surface between the driving liquid and the slurry is raised to lift the float member F1 to actuate the detector SH1. The detector SH1 then produces a signal which is used to close the change-over valve C1. Then, as the change-over valve A1 is opened, the check valve B1 is closed by the fluid pressure and, simultaneously, the check valve D1 is opened, so that the slurry is depressed by the driving liquid to be forcibly supplied to the transfer pipe 18 through the outlet pipe 15 and the check valve D1. As a result, the boundary surface between the driving liquid and the slurry is lowered together with the float member F1 to be detected by the detector SL1, so that a signal issued from the detector SL1 is used to close the change-over valve A1.

By repetition of the above-mentioned operation, it is possible to displace the slurry into the transfer pipe 18, making only use of the vessel 1. It will be understood that a continuous pumping of the slurry into the transfer pipe 18 is possible by using other vessels 2 and 3.

The driving liquid outlet pipes 8–10 are commonly provided with a flow control valve 19 which is adapted to receive a signal produced by an orifice 20 for detecting the flow rate Q1 of the discharged slurry and to automatically control its opening degree so as to substantially correspond with the detected flow rate Q1. The result of the control of the flow rate is checked by a signal detected by an orifice 21.

With the practical apparatus, however, it is impossible to make the discharging flow rate Q1 of the slurry strictly equal to the charging flow rate Q2 of the slurry. To solve this problem, a switching-over means 22 is provided which controls the flow rate Q2 to be either slightly smaller (Q2=0.95 Q1) or slightly larger (for example, Q2=1.05 Q1) than the flow rate Q1. In addition, a time relay 23 is provided which is adapted to operate for a predetermined period of time from that point of time when the detector SL detects the float member to produce a signal for closing the change-over valve An and opening a change-over valve An+1. The same sequence continues unless a signal for opening the change-over valve C fo the same vessel is produced within the predetermined period of time. When the signal for opening the change-over valve C is produced within the predetermined period of time, the switching-over means having been operated on the sequence Q2=1.05 Q1 is switched over to the sequence (Q2=0.95 Q1). Thus the time interval from closing of the valve C to opening of the change-over valve A is shortened. A time relay 23 is provided which operates for a predetermined period of time from that point of time when signal for closing the change-over valve C is delivered. When the above time interval exceeds the predetermined period of time during which the time relay 23 is operated, the operation mode is switched over to the second mode (Q2=1.05 Q1), and the operation is continued in this manner.

The detectors SL1–SL3 and SH1–SH3 are connected to a controller 24 in accordance with the invention which controller functions in the following three manners.

Figure 2:
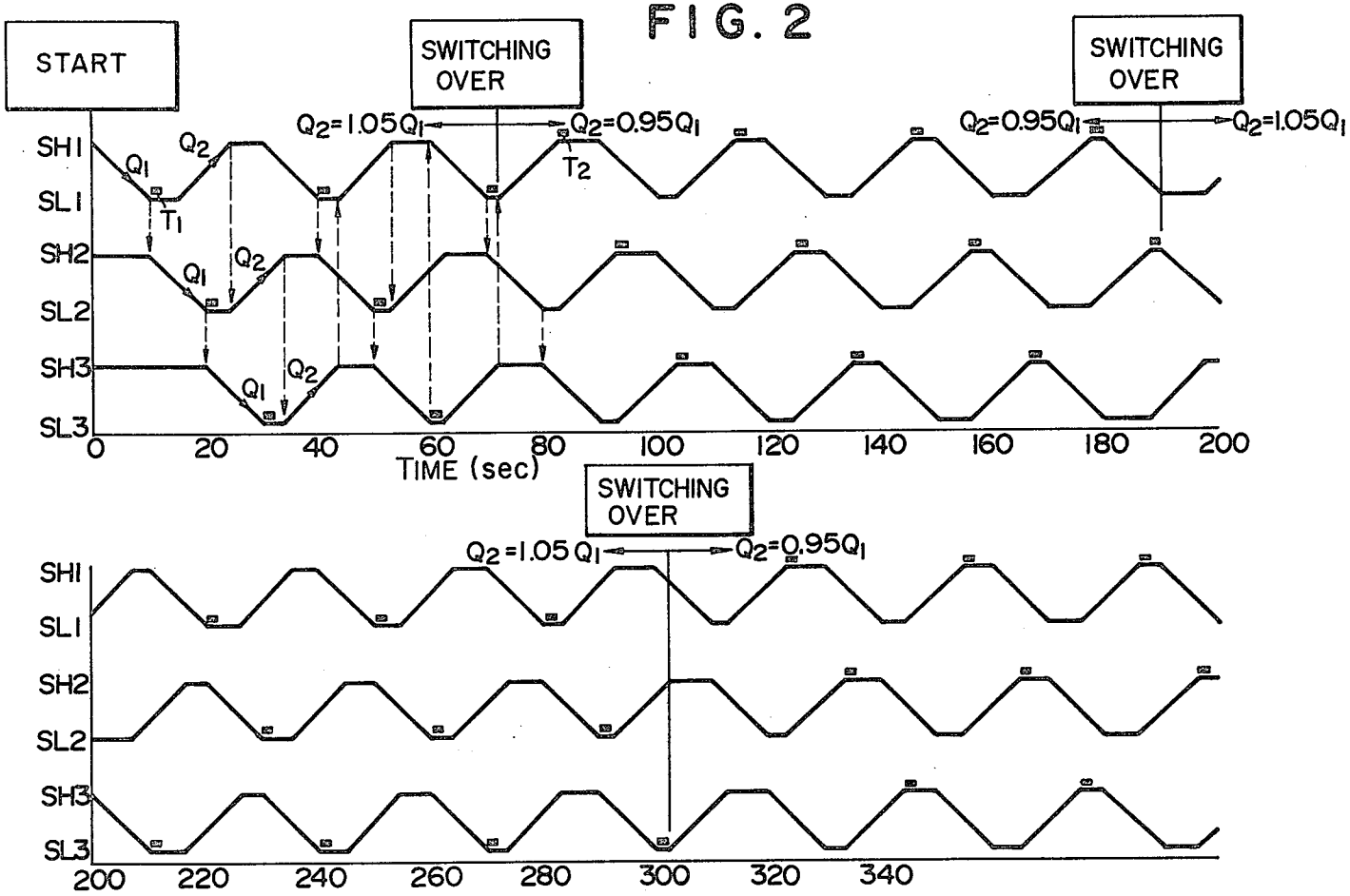
FIG. 2 is a time chart showing the sequential operation of the continuous slurry displacement transfer apparatus according to the invention.

(b 1) Firstly, the controller serves to add up the total number of vessels during upward movement (during charging of slurry) or during downward movement (during discharging of slurry) in FIG. 2, and to compare the total number with a set value.

(2) Secondly, the controller serves to calculate the time interval from opening of the valve An to arrival of the float member F at the lower limit position detector SLn and the time interval from opening of the valve B to arrival of the float member F at the upper limit position detector SHn, and to compare these time intervals with set values.

(3) Thirdly, the controller serves to calculate on the basis of the flow rate Q1 the time interval taken by the float member F moving from the level of the upper limit position detector SHn (the valve A being opened) to the level of the lower limit position detector SLn, and on the basis of the flow rate Q1 the time interval taken by the float member F moving from the level of the lower limit position detector SLn (valve B open) to the level of the upper limit position detector SHn, and to compare the calculated time intervals with set values.

The above-mentioned three set values are set within certain ranges in terms of errors of measuring instruments and so forth.

Failure informing devices 25, 26 are connected to the controller 24. The failure informing device 25 is adapted to operate upon receipt of signals produced in accordance with the first function of the controller 24 while the failure informing device 26 is adapted to operate upon receipt of signals produced in accordance with the second and third functions of the controller 24.

As will be seen from FIG. 2, the total number of vessels amounts to eleven when the apparatus operates in the first mode Q2=1.05 Q1 or in the second mode Q2=0.95 Q1. When the above total number of vessels is beyond the set values, comes for example below 8 or above 11, the controller 24 produces a signal in accordance with its first function to cause the failure informing device 25 to display or inform the occurence of the failure. That is, the failure informing device 25 informs the operator that the valves B or D are faulty when the total number of the vessels during discharge of the slurry is more than the set value, and that the valves A or C are faulty when the total number of the vessels is less than the predetermined set value.

Although the failure informing device 25 can detect that the valves B and D or the valves A and C are faulty, it is not possible to determine which one of the valves B and D or which one of the valves C and D is faulty. It is, however, possible to determine any faulty valve of the valves An-Dn by actuating the failure informing device 26 on the basis of the second and third functions of the controller 24, as will be seen from FIG. 3.

In case the float member is rapidly moved up in FIG. 3, the valves B and C are in the closed position and the valve D is in a faulty condition to permit leakage. Namely, in this case, the high pressure acts on the underside of the float member to rapidly move the same. To the contrary, in case the float member is slowly moved up, the valves B and C are in closed condition and leakage is taking place in the faulty valve A. Namely, in this case, the high pressure is exerted on the upper side of the float member to slowly move the same upward.

On the other hand, in case the float member is rapidly moved downward, the valves A and D are in the opened position and the valve B is in the faulty state to permit leakage. In this case, the pressure on the valve A is higher than that on the valve B, so that the high pressure acts on the upper side of the float member to rapidly move the same downward. To the contrary, in case the float member is slowly moved downward, the valves A and D are in the closed position and the valve C is faulty to permit leakage. Accordingly, the float member is slowly moved downward since the pressure acting on the upper side of the float is reduced.

From the foregoing description, it will be understood by those skilled in the art that, according to the invention, the actual condition of any failure can be detected before the sequence becomes out of order, so that inspection and maintenance of the slurry displacement transfer apparatus are very much facilitated to improve its safety and reliability.

Although the invention has been described by way of example, it is to be noted here that the embodiment as described above is not exclusive, and various changes and modifications may be imparted thereto without departing from the scope and spirit of the invention which is limited solely by the appended claims.

What is claimed is:

1. An apparatus for continuous slurry displacement transfer comprising a plurality of vessels arranged in parallel, driving liquid inlet and outlet pipes each having a valve therein and connected to the top portion of each vessel, slurry inlet and outlet pipes each having a valve therein and connected to the bottom portion of each vessel, float members each disposed in each vessel, detectors provided outside of said vessels for detecting said float members coming to their upper and lower limit positions in said vessels, and controller means to which said detectors are connected; characterized by failure informing means connected to said controller means, said controller means being adapted to calculate the time periods of time taken by said float members in each vessel moving between the levels of both upper and lower limit position detectors, said failure informing means being responsive to said controller means for indicating or informing the operator of any failure taking place in said apparatus when the calculated period of time of movement of said float members calculated by said controller means has become longer or shorter than a predetermined period of time.

2. An apparatus as claimed in claim 1 wherein said valves provided in said slurry inlet and outlet pipes are check valves.

3. An apparatus as claimed in claim 1 wherein said driving liquid inlet and outlet pipes are provided with switching-over means which automatically controls the apparatus such that the charging flow rate Q2 of the slurry is slightly larger (Q2=Ka Q1) or smaller (Q2=Kb Q1) than the discharging flow rate Q1 in the respective vessels.

4. An apparatus as claimed in claim 1 wherein said periods of time taken by said float members moving between the levels of both upper and lower limit position detectors are determined by the charging flow rate Q2 of the slurry and the discharging flow rate Q1 of the slurry.

5. An apparatus for continuous slurry displacement transfer including a plurality of vessels arranged in parallel, driving liquid inlet and outlet pipes each having a valve therein and connected to the top portion of each vessel, slurry inlet and outlet pipes each having a valve therein and connected to the bottom portion of each vessel, float members each disposed in each vessel, detectors provided outside of each vessel for detecting said float members in each vessel coming to their upper and lower limit positions, characterized by switching-over means for automatically controlling the apparatus such that the charging flow rate Q2 of the slurry is slightly larger (Q2=Ka Q1) or smaller (Q2=Kb Q1) than the discharging flow rate Q1 of the slurry in the respective vessels, controller means connected to said detectors for said float members disposed in said respective vessels, and failure informing means connected to said controller means, said controller means being adapted to add up the total numbers of the vessels brought into operation during the operations on the basis of Q2=Ka Q1 and Q2=Kb Q1, said failure informing means being responsive to said controller means for displaying or informing the operator of a failure taking place in the apparatus when said added number of vessels totaled by said controller means has become larger or smaller than set values.

6. An apparatus as claimed in claim 5 wherein the valves disposed in said slurry inlet and outlet pipes are check valves.

7. An apparatus for continuous slurry displacement transfer comprising a plurality of vessels arranged in parallel, driving liquid inlet and outlet pipes each having a valve therein and connected to the top portion of each vessel, slurry inlet and outlet pipes each having a valve therein and connected to the bottom portion of each vessel, float members each disposed in each vessel, detectors provided outside of said vessels for detecting said float members coming to their upper and lower limit positions in said vessels, and controller means connected to said detectors and to said pipes for at least determining the opening condition of said valve in said driving liquid inlet pipe and said slurry inlet pipe of each vessel; characterized by failure informing means connected to said controller means, said control means being adapted to calculate the time interval from opening of a respective liquid inlet pipe valve to the arrival of said associated float member at the lower limit position and the time interval from the opening of said slurry inlet pipe valve for each vessel to arrival of said associated float member at the upper limit position, said failure informing means being responsive to said controller means for indicating or informing the operator of any failure taking place in said apparatus when the calculated time interval of movement of said float members after opening of said valves calculated by said control means has become longer or shorter than a predetermined period of time.

* * * * *